US006863359B2

(12) United States Patent
Irizawa et al.

(10) Patent No.: US 6,863,359 B2
(45) Date of Patent: Mar. 8, 2005

(54) INK-JET PRINTING APPARATUS AND INK-JET PRINTING METHOD

(75) Inventors: Takeshi Irizawa, Yokohama (JP); Makoto Aoki, Yokohama (JP); Yoshiko Miyashita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 10/289,345

(22) Filed: Nov. 7, 2002

(65) Prior Publication Data

US 2003/0085956 A1 May 8, 2003

Related U.S. Application Data

(62) Division of application No. 09/215,191, filed on Dec. 18, 1998, now Pat. No. 6,543,869.

(30) Foreign Application Priority Data

Dec. 18, 1997 (JP) ..... 9-349701

(51) Int. Cl.[7] ..... B41J 29/38
(52) U.S. Cl. ..... 347/14; 347/60
(58) Field of Search ..... 347/14, 60, 9–12, 347/43, 19, 17

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,723,129 A | | 2/1988 | Endo et al. | 346/1.1 |
| 4,740,796 A | | 4/1988 | Endo et al. | 346/1.1 |
| 4,774,529 A | | 9/1988 | Paranjpe et al. | 346/140 |
| 4,791,435 A | * | 12/1988 | Smith et al. | 347/17 |
| 5,606,355 A | * | 2/1997 | Komatsu | 347/60 |
| 5,610,635 A | | 3/1997 | Murray et al. | 347/7 |
| 5,838,340 A | | 11/1998 | Shimoda | 347/14 |
| 5,988,782 A | | 11/1999 | Miura et al. | 347/6 |
| 6,116,710 A | | 9/2000 | Tajika et al. | 347/14 |
| 6,435,643 B1 | | 8/2002 | Miura et al. | 347/19 |
| 6,447,085 B1 | | 9/2002 | Yagi et al. | 347/9 |

FOREIGN PATENT DOCUMENTS

| | | | | |
|---|---|---|---|---|
| EP | 646460 | * | 4/1995 | |
| EP | 0 646 460 | | 4/1995 | |
| EP | 736388 | * | 4/1996 | |
| EP | 0 719 647 | | 7/1996 | |
| EP | 0 736 388 | | 10/1996 | |
| EP | 0 750 994 | | 1/1997 | |
| JP | 59-123670 | | 7/1984 | |
| JP | 59-138461 | | 8/1984 | |
| JP | 5-212851 | | 8/1993 | |
| JP | 05330122 A | * | 12/1993 | B41J/2/36 |
| WO | 96/14989 | | 5/1996 | |

* cited by examiner

*Primary Examiner*—Russell Adams
*Assistant Examiner*—Ly T Tran
(74) *Attorney, Agent, or Firm*—Fitzpatrick, Cella, Harper & Scinto

(57) ABSTRACT

An ink/print media discriminating portion discriminates kind of ink to be used in an apparatus on the basis of information of kind of the ink or a printing medium input by a user. The discrimination information is fed to a thermal energy generation amount control portion. The thermal energy generation amount control portion sets a driving condition, such as a pulse width of a drive pulse or the like corresponding to the kind of the ink represented by the discriminated information, is set in a head driving portion.

16 Claims, 7 Drawing Sheets

INK-JET PRINTING APPARATUS AND INK-JET PRINTING METHOD

This application is a division of application Ser. No. 09/215,191, filed Dec. 18, 1998, U.S. Pat. No. 6,543,869.

This application is based on Patent Application No. 9-349,701 (1997) filed Dec. 18, 1997 in Japan, the content of which is incorporated hereinto by reference.

BACKGROUND OF THE INVENTION

1. Field of the Invention

The present invention relates generally to an ink-jet printing apparatus and an ink-jet printing method. More particularly, the invention relates to an ink-jet printing apparatus and an ink-jet printing method performing printing using inks adapted to printing media to be used for printing.

2. Description of the Related Art

As a printing method to obtain high definition and high preciseness image, a printing method employing an ink-jet printing apparatus performing ink ejection using a thermal energy generated by an electrothermal transducer, has been known. The ink-jet printing apparatus of this system has less constraint in selection of the printing media actually used in the light of principle of printing. In the recent years, kinds of printing media to be used in such printing apparatus is becoming wide variety. By the ink-jet printing apparatus, in addition to a coated paper which has been used conventionally, printing can be performed on plain paper, what we call, transparent sheet, glossy paper, a back-print film, leather, wood or the like, for example. In the alternative, textile printing can also be performed on a cloth fabricated from cotton, rayon (artificial silk), hemp, silk, nylon, polyester or the like.

On the other hand, associating with increasing the variety of printing media to be used, in viewpoint of use of inks adapted to property of the printing media, such as material or the like, kinds of inks to be used in the ink-jet printing apparatus is increasing. As such inks, in addition to a water soluble dye ink which has been used normally, a water-soluble dye ink in concentrated form, an ink using a water insoluble dye, a pigment ink, a non-aqueous ink and the like are used, for example.

These large number of kinds of inks are used depending upon kind of the printing media, color or density required in printing images, image fastness and so on, namely depending upon specification required for printing apparatus. Therefore, the large number of kinds of inks are used by simultaneously using several kinds of inks in the same printing apparatus, or by exchanging inks within a printing head or an ink path every time of varying kinds of the printing media.

However, among large number of kinds of inks just described, when a water-soluble dye ink in concentrated form, an ink using water insoluble dye, a pigment ink and the like are used, for example, it is relatively difficult to stably eject the ink from the printing head to possibly cause plugging or ejection failure, and damaging of the head caused by plugging or ejection failure.

Particularly, in the ink-jet printing apparatus using a thermal energy by the electrothermal transducer, damage, to which the printing head is subjected by the heat, degree of bubbling, variation of viscosity of the ink, initial ejection characteristics and so on have varied depending upon the kind of the ink to be used. Therefore, difficulty is encountered to perform optimal ejection for all kinds of the inks under the same head driving condition.

SUMMARY OF THE INVENTION

The present invention has been worked out in view of resolving the problems set forth above. Therefore, it is an object of the present invention to provide an ink-jet printing apparatus and an in-jet printing method which may not cause problem in ejection characteristics and life of a printing head even when a plurality of kinds of inks having different characteristics are used.

In a first aspect of the present invention, there is provided an ink-jet printing apparatus performing printing on a printing medium by a printing head using a plurality of kinds of inks and ejecting the ink utilizing thermal energy, comprising:

ink discriminating means discriminating kind of the ink on the basis of information relating to kind of the ink ejected from the printing head;

driving condition setting means for setting a driving condition of the printing head on the basis of the kind of ink discriminated by the ink discriminating means; and head driving control means for controlling driving of the printing head for ejection on the basis of the driving condition set by the driving condition setting means.

Here, the driving condition of the printing head may be a condition relating to a generation amount of a thermal energy.

Information in relation to kind of the ink may be kind of the ink or kind of the printing medium.

The printing head may generate the thermal energy by application of a divided pulse consisted of a plurality of pulses and the driving condition setting means may set a pulse width of a leading pulse depending upon the discriminated kind of the ink.

The drive condition setting means may set a pulse width of the trailing pulse constant irrespective of kind of the discriminated kind of the ink.

The driving condition setting means may consist the divided pulse for ejection opening of the printing head not ejecting the ink with only leading pulse, and applied amount of the leading pulse may be controlled depending upon the discriminated kind of the ink.

At least one kind of the plurality of kinds of inks may be a water insoluble ink or a pigment ink.

The printing medium may be a cloth.

At least a combination of the printing medium being a polyester cloth and the ink being a disperse dye ink, may be included.

A plurality of kinds of inks may be a dye ink and a pigment ink, respectively.

A plurality of kinds of inks may be reactive dye ink and a disperse dye ink.

When printing is performed on the printing medium by the printing head ejecting the disperse dye ink, the driving condition setting means may set the pulse width of the leading pulse small.

In a second aspect of the present invention, there is provided an ink-jet printing method comprising:

first step of discriminating a kind of an ink on the basis of an information concerning a kind of the ink to be ejected from a printing head ejecting the ink utilizing a thermal energy using a plurality of kinds of inks, second step of setting a driving condition of the printing head on the basis of the kind of the ink discriminated at the first step; and third step of controlling driving of the printing head for ejection on the basis of the driving condition set at the second step.

Here, the driving condition of the printing head may be a condition relating to a generation amount of a thermal energy.

Information in relation to kind of the ink may be kind of the ink or kind of the printing medium.

The printing head may generate the thermal energy by application of a divided pulse consisted of a plurality of pulses and a pulse width of a leading pulse depending upon the discriminated kind of the ink is set.

A pulse width of the trailing pulse constant irrespective of kind of the discriminated kind of the ink may be set.

The divided pulse for ejection opening of the printing head not ejecting the ink with only leading pulse may be set, and applied amount of the leading pulse controlled depending upon the discriminated kind of the ink may be set.

At least one kind of the plurality of kinds of inks may be a water insoluble ink or a pigment ink.

The printing medium may be a cloth.

At least a combination of the printing medium being a polyester cloth and the ink being a disperse dye ink, may be included.

A plurality of kinds of inks may be a dye ink and a pigment ink, respectively.

A plurality of kinds of inks may be reactive dye ink and a disperse dye ink.

When printing is performed on the printing medium by the printing head ejecting the disperse dye ink, the pulse width of the leading pulse small may be set.

With the construction set forth above, in the ink-jet printing apparatus which can use a plurality of kinds of inks, a kind of the ink to be used for printing is discriminated. Depending upon this, head driving condition relating to generation amount of the thermal energy in the head relating to the ink ejection, is set. Therefore, irrespective of the kind of the ink to be used, ejection characteristics can be constantly optimal. Also, damage for the head upon ejection can be minimized.

As set forth above, according to the present invention, in the ink-jet printing apparatus capable of using a plurality of kinds of the inks, the kind of the ink to be used for printing can be discriminated. Depending upon result of discrimination, a head driving condition relating to generation amount of the thermal energy in the head relating to ink ejection, can be set to constantly optimize ejection characteristics irrespective of the kind of the ink to be used. Also, damage of the head upon ejection can be minimized.

As a result, it becomes possible to provide the ink-jet printing apparatus which can avoid plugging of the ink or ejection failure, prevent occurrence of damaging of the head and so on, and stably output high definition and high preciseness image on each kind of the printing medium.

The above and other objects, effects, features and advantages of the present invention will become more apparent from the following description of the embodiments thereof taken in conjunction with the accompanying drawings.

DESCRIPTION OF PREFERRED EMBODIMENTS

Embodiments of the present invention will be described hereinafter in detail with reference to the drawings. It should be noted that the following description will be given in terms of a textile printing apparatus using a cloth as a printing medium.

Figure 1:
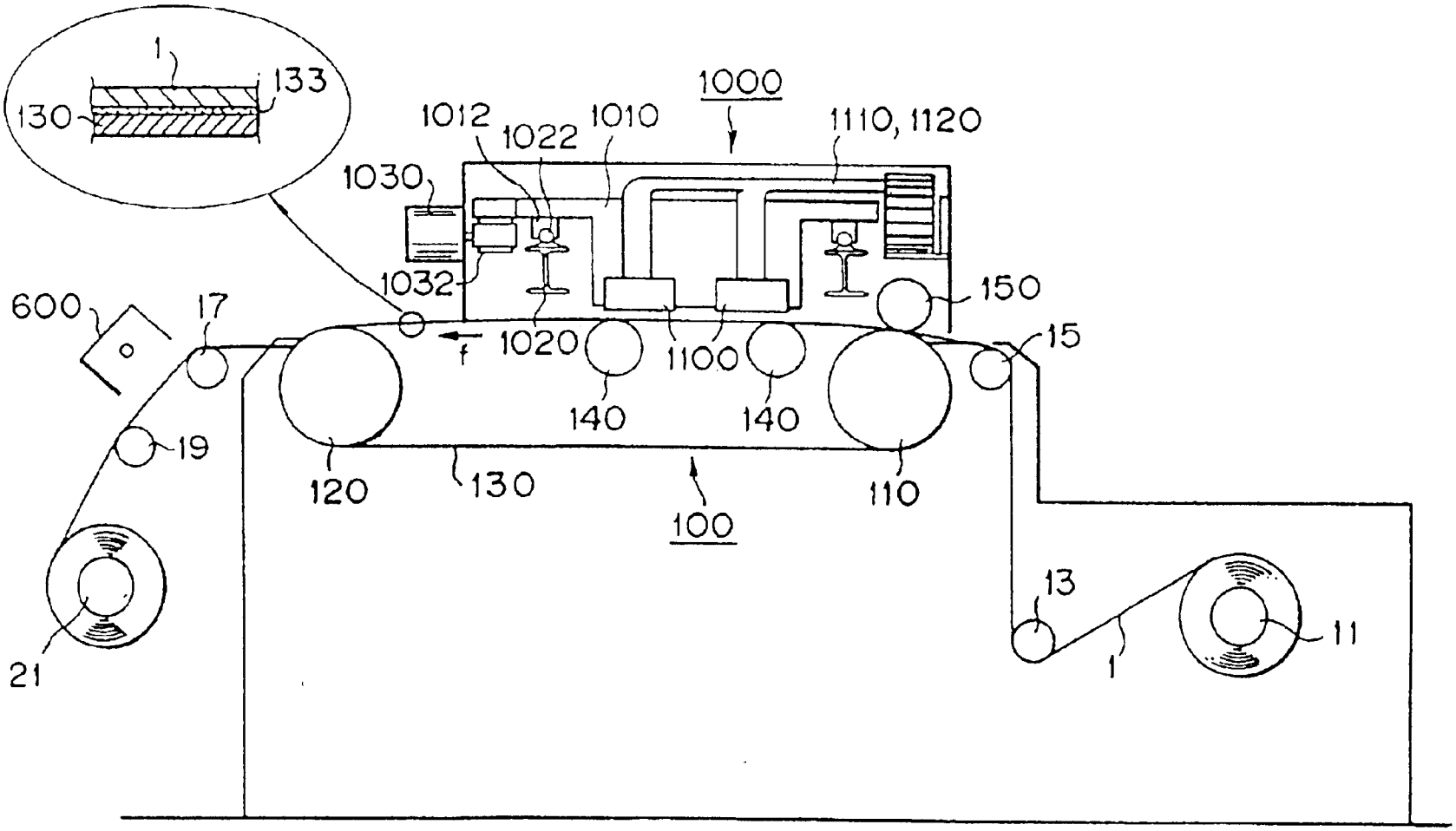
FIG. 1 is a diagrammatic sectional side elevation showing a general construction of a textile printing apparatus as one embodiment of an ink-jet printing apparatus according to the present invention.

FIG. 1 is a diagrammatic sectional side elevation showing a general construction of a textile printing apparatus as an ink-jet printing apparatus. In FIG. 1, the reference numeral 1 denotes a cloth as a printing medium. The cloth 1 is extracted according to rotation of a feeding roller 11. The cloth 1 extracted is transported in substantially horizontal direction by a transporting portion 100 provided at a portion opposing to a printing portion 1000 via intermediate rollers 13 and 15, and thereafter, is taken up onto a take-up roller 21 via a feeding roller 17 and an intermediate roller 19.

The transporting portion 100 generally has transporting rollers 110 and 120 provided on upstream side and downstream side of the printing portion 1000 in the transporting direction of the cloth 1, an endless belt form transporting belt 130 wrapped around the transporting rollers 110 and 120, and a pair of platen rollers 140 stretching the transporting belt 130 with a proper tension within a predetermined range in order to restrict a textile surface being printed of the cloth 1 into flat when a textile printing is performed by the printing portion 1000.

Here, in the shown printing apparatus, as the transporting belt 130, a metallic belt disclosed in Japanese Patent Application Laying-open No. 5-212851 (1993), for example. As shown in partially enlarged form in FIG. 1, on the surface, an adhesive layer (sheet) 133 is provided.

Then, the cloth 1 is adhered on the transporting belt 130 via the adhesive layer 133 by an adhering roller 150 to certainly provide flatness for textile printing.

The cloth 1 transported with maintaining flatness is applied an ink by an ink-jet head (printing head) 1100 of the printing portion 1000 in a region between two platen rollers 140. Subsequently, the cloth 1, to which the ink is applied, is peeled off the transporting belt 130 or the adhesive layer 133 at the portion of the transporting roller 120 and taken up on the take-up roller 21. At the intermediate portion, by a drying heater 600, a drying process is performed. The drying heater 600 is particularly effective when a liquid is used as a printing agent. As the drying heater 600, one blowing a hot air to the cloth 1, one irradiating an infrared ray and so on may be selected appropriately.

Figure 2:
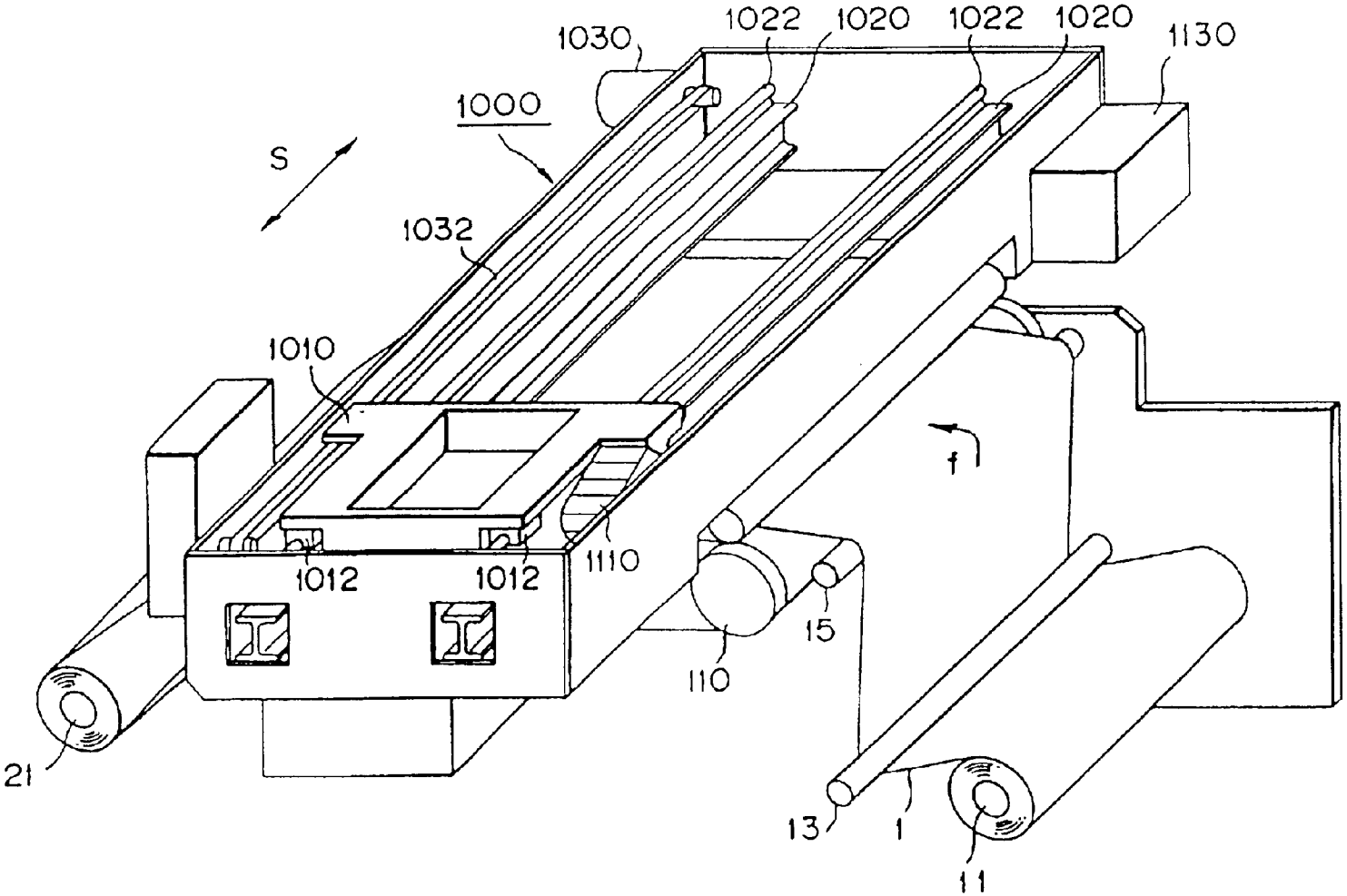
FIG. 2 is a perspective view diagrammatically showing a printing portion and a transporting portion in the apparatus shown in FIG. 1.

FIG. 2 is a perspective view diagrammatically showing the printing portion 1000 and a transporting system of the cloth 1. An explanation will be given for a construction of the printing portion 1000 using FIG. 2 together with FIG. 1.

At first, in FIGS. 1 and 2, the printing portion 1000 has a carriage 1010 which is movable in a direction different from a transporting direction (auxiliary scanning direction) f, for example, in a width direction S of the cloth 1 perpendicular to the transporting direction f. The reference numeral 1020 is a support rail extending in S direction (primary scanning direction). On the support rail 1020, a slide rail 1022 is mounted therealong. Then, by slidably supported a slider 1012 fixed on the carriage 1010 on the slide rail 1022, movement of the carriage 1010 becomes possible. The reference numeral 1030 denotes a motor serving as a driving source for performing motion of the carriage 1010. A driving force of the motor 1030 is transmitted to the carriage 1010 through a belt 1032, having a part of which is connected to the carriage 1010, or through other transmission mechanism.

On the carriage 1010, a plurality of printing heads 1100, in each of which ink ejection openings 78 to number of 1408 are arranged in a predetermined direction, corresponding to respective ink colors are mounted. Namely, these plurality of printing heads 1100 are arranged in the primary scanning direction S. Two sets of such plurality of printing heads 1100 are mounted in the transporting direction of the printing medium (see FIG. 1).

While each set of the printing heads 1100 may be selected properly depending upon an image or the like to be formed on the cloth 1. For example, the printing heads 1100 may eject inks of three primary colors of yellow (Y), magenta (M) and cyan (C) and in addition black (Bk). Also, together with these, the printing head 1100 ejecting special color (metallic color of gold, silver and the like, vivid or rich red or blue, and so on) which is impossible or difficult to express by the three primary colors, may be used. In the alternative, even in the same color, the printing heads ejecting inks of different densities may be used.

In these printing heads 1100, different kinds of inks (hereinafter means inks having different compositions for substantially the same color) having good suitableness depending upon kind of the cloth to be used as the printing medium, may be used. Therefore, the same printing heads 1100 are used in the shown embodiment. Ink supply systems which will be explained later, are provided for respective kinds of inks. Then, exchanging of inks in the printing heads 1100 may be performed together with the ink supply systems.

It should be noted that colors of the inks, number of the printing heads to be arranged, order of the printing heads of arrangement or the like, employed in the printing heads 1100 in each set, may be differentiated depending upon the image or the like to be printed by textile printing. On the other hand, it is possible that, for a region to be textile printed by the primary scan of the first set of the printing heads 1100, textile printing may be performed again by the other set of the printing heads 1100 (in this case, complementary thinning textile printing or overlying printing may be performed by each set of printing head 1100, for example). Also, by sharing textile printing region, a high speed printing may be performed. Furthermore, number of sets of the printing heads 1100 is not specified to two sets, but can be one set or three or more sets.

Each of the printing heads 1100 has a heater element causing film boiling in the ink for generating a thermal energy and thus forms an bubbling ink-jet type head. Each printing head 1100 is mounted with orienting the ink ejection openings 78 downwardly so as to oppose with a printing surface of the cloth 1 transported in substantially horizontal direction by transporting portion 100. Accordingly, a water head difference between respective ejection openings 78 is reduced to enable formation of good image by making ejecting condition uniform, for enabling uniform recovery process for all of the ejection openings 78.

In each printing head 1100, electrical wiring in the flexible tube 1110 provided to follow movement of the carriage 1010 is connected. Accordingly, between each printing head 1100 and a not shown control means, feeding and receiving all the various kinds of signal, such as a head drive signal, a head condition signal and the like can be performed. On the other hand, for the printing head 1100, by the ink supply system 1130 storing the ink of each color, the ink of each color is supplied through each tube provided in the flexible tube 1110.

Figure 3:
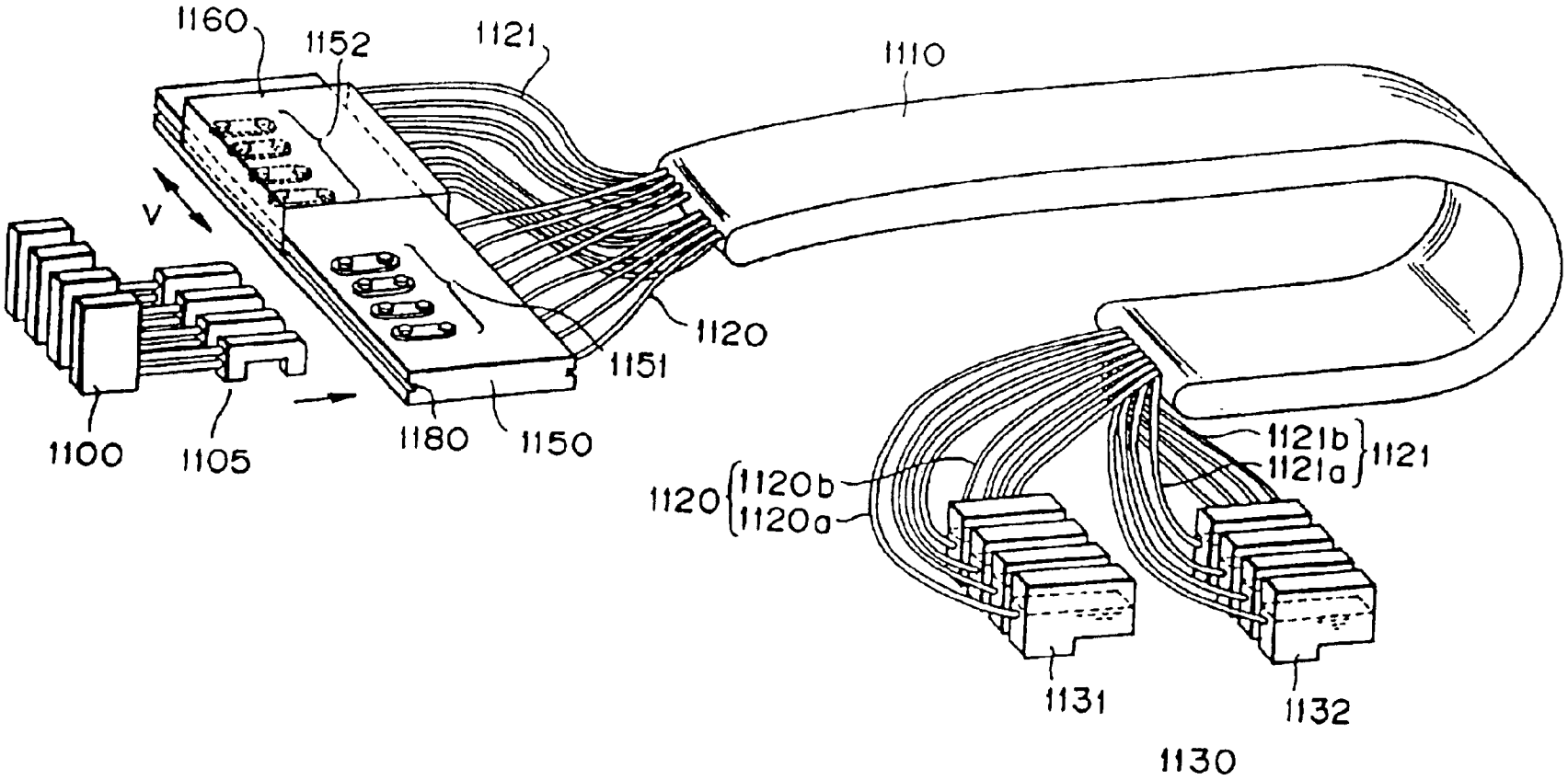
FIG. 3 is a diagrammatic perspective view showing an ink supply system in the apparatus shown in FIG. 1.

FIG. 3 is a perspective view showing an ink supply system in the shown embodiment. The ink supply system 1130 is constructed with two systems. Namely, in the first system, a first ink supply tube 1120 connected to a first set of ink storage tank 1131 is connected to a head connecting portion 1150 through the flexible tube 1110. Similarly, in the second system, a second ink supply tube 1121 connected to a second ink storage tank 1132 is connected to the head connecting portion 1150 through the flexible tube 1110.

Here, the ink supply tubes 1120 and 1121 are constituted of forward ink supply tubes 1120*a* and 1121*a* and return ink supply tubes 1120*b* and 1121*b*, respectively. Accordingly, a circulation path is established between the tank and the printing head 1100. Namely, the foregoing ink storage tanks 1131 and 1132 have not shown pressurizing pumps, respectively. On the other hand, inks in respective of the tanks 1131 and 1132 are circulated in the printing heads 1100 through the forward ink supply tubes 1120*a* and 1121*a* under pressure by this pump and returned to the ink storage tanks 1131 and 1132 through the return ink supply tubes 1120*b* and 1121*b*.

Furthermore, upon exchanging of the inks, by pressuring by the pressurizing pumps under a condition where not shown valves provided in the paths of the return ink supply tubes 1120*b* and 1121*b* are closed, inks which cannot be circulated are discharged through ejection openings 78 of the printing head 1100.

By this operation, a desired ink within the printing head 1100 can replaced from the ink previously filled with an ink to be used for printing.

Next, the foregoing valve is opened, pressurization is performed by the pressurization pump to re-fill the ink even in the return ink supply tubes 1120*b* and 1121*b*.

On the other hand, the pressurization pump is also used upon recovery operation for preventing plugging or the like of the head. In this case, pressurization is performed in the condition where the foregoing valves are held open to circulate the ink between the tank and the printing head 1100. Then, a part of the ink is discharged from the ejection openings 78 of the printing head 1100. Accordingly, foreign matter or bubble, or the ink having increased viscosity can be discharged out of the head.

It should be noted that it is also possible to employ a mechanism for sucking the ink, in place of that discharging of the ink. Here, respective of the ink storage tanks 1131 and 1132, a plurality of tanks are provided corresponding to the inks to be used in the printing heads 1100.

The head connecting portion 1150 includes a head connecting portion 1151 corresponding to the first set shown by solid line portion of FIG. 3, a head connecting portion 1152 corresponding to the second set shown by broken line, and a connecting portion cover 1160.

Figure 4:
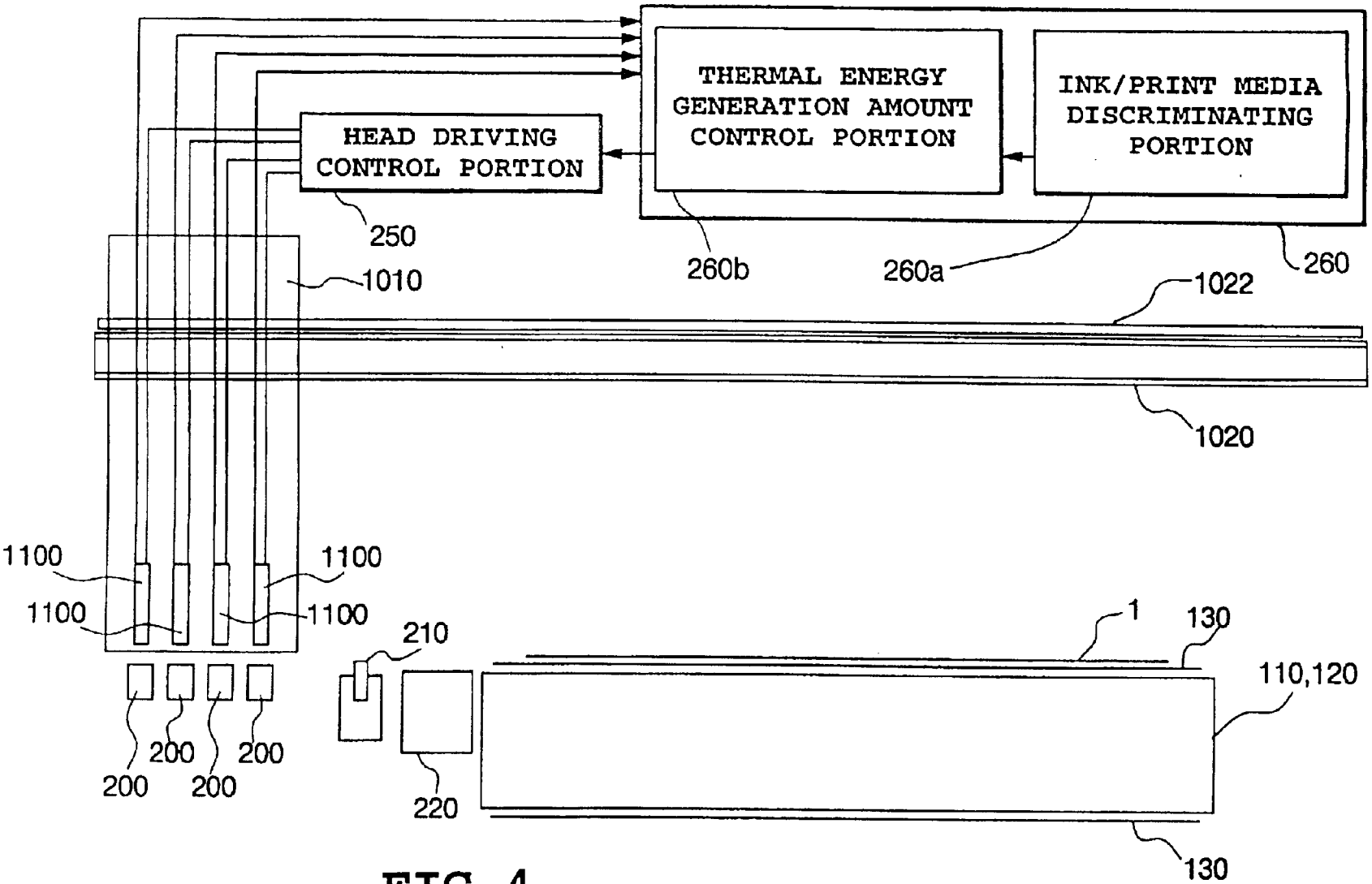
FIG. 4 is a diagrammatic illustration showing a construction of an ejection recovery system and a control system in the apparatus shown in FIG. 1.

FIG. 4 is an illustration diagrammatically showing an ejection recovery system and a control system in the textile printing apparatus set forth above.

A capping unit 200 provided corresponding a plurality of printing head 1100 are in contact with a surface of the ejection openings 78 of respective printing head 1100 upon non-printing and prevent dehydration of the ejection openings 78, and restrict the mixing of the foreign matter into the ejection openings 78, or remove it. Particularly, upon non-printing, the printing head 1100 is moved to the position opposed to the capping unit 200. Then, the capping unit 200 is driven frontwardly by the capping driver (not shown) to enable capping by contacting an elastic member onto the surface of the ejection openings 78 under pressure.

The blade 210 is constructed with a continuous porous body as a three-dimensional network structural body, for example, having a flexibility. As a material of the blade 210, a high-molecular porous body is preferred. When the high-molecular porous body is used, one does not vary a volume even when the ink is absorbed, instead of those causing significant volume variation by absorption of the ink mist, such as a high-molecular foamed body. For example, one of a foamed formal resin type may be used. On the other hand, in addition to the porous body, other three dimensional network structural body can be used as a matter of course. On the other hand, as a blade 210 to be used, heat sintered type high-molecular porous body may also be used. For example, heat sintered body of low-density polyethylene, high-density polyethylene, polymeric polyethylene, composite polyethylene, polypropylene, polymethyl metaacrylate, polystyrene, acrylonitrile type copolymer, ethylene-vinyl acetate copolymer, fluorine plastics, phenolic resin and the like may be used. Amongst, in viewpoint of absorbency of ink mist and ink corrosion resistance, low-density polyethylene, high-density polyethylene, polymeric polyethylene, polypropylene are preferred.

A plugging prevention unit 220 receives the ink ejected by preparatory ejection operation. Namely, in the case where printing head 1100 does not perform ejection for a predetermined period, the printing head 1100 performs operation for discharging the ink of the increased viscosity which can be caused by evaporation of the ink in the vicinity of the ejection openings 78, by ejection of the ink. By preparatory ejection operation, improvement of reliability of ejection, such as prevention of plugging or optimization of the initial ejection characteristics of the ejection opening 78 can be achieved. The plugging prevention unit 220 has a liquid receptacle member opposing to the printing head 1100 and absorbing the ejected ink. The liquid receptacle member is disposed between the capping unit 200 and a printing start position. It should be noted that, as a material of the liquid receptacle material, a sponge form porous member and the like may be effective.

A control portion 260 implementing control of the overall ink-jet printing apparatus of the shown embodiment, has CPU and memory, such as RAM, ROM and the like. In the control portion 260, an ink/printing media discriminating portion 260*a* and a thermal energy generation amount control portion 260*b* are provided. These discriminating portion 260*a* and the control portion 260*b* may be in a form of table, or, in the alternative, may be a system for discriminating the inks and the printing medium and controlling thermal energy generation amount by a predetermined program. Namely, the ink/printing media discriminating portion 260*a* makes discrimination of the inks and the printing media to be used in the printing apparatus depending upon key entry through an operation panel of the printing apparatus or setting of the ink or the like in a host system to transmit a result of discrimination to the thermal energy generation amount control portion 260*b*. Then, the thermal energy generation amount control portion 260*b* transmits a control signal depending upon the result of discrimination to a head driving control portion 250. Accordingly, a head driving condition is set in the head driving control portion 250. It should be noted that, in the ink/printing media discriminating portion 260*a*, with respect to the printing media to be discriminated, finally the kinds of the inks are corresponded. Then, the control signal depending upon the kind of the ink is transmitted from the thermal energy generation amount control portion 260*b* to the head driving control portion 250. On the other hand, in the ink/printing media discriminating portion 260*a*, setting relating to the kind of the ink is normally set automatically. Therefore, by discriminating the printing medium as set forth above, the ink having good suitableness with the printing medium to be use is set automatically.

However, even when printing is performed for the same printing medium, a plurality of kinds of the inks can be present depending upon the object, for example, such as printing on the printing medium having high weathering resistance, printing to the printing medium of the type having high color development ability and so on. In this case, in the ink/printing medium discriminating portion 260*a*, in addition to the kind of the in to be automatically set depending upon the printing medium, the user may re-set the kind of the ink depending upon the object.

On the other hand, when the discriminated printing medium and the kind of the ink are not in a previous corresponding relationship, the control signal corresponding to the kind of the ink is preferentially transmitted by the ink/printing media discriminating portion 260*a*.

Next, explanation will be given for the cloth as the printing medium.

Fiber material of the cloth for ink-jet textile printing is not particularly limited and cotton, silk, wool, nylon, polyester, rayon, acrylic fiber and other various fiber material can be used. Also, blended yarn fabric, union cloth (cowoven fabric) made of these fiber material may also be used.

The cloth for textile printing requires a preliminary treatment, and a preliminary treatment agent is preliminarily applied to the cloth. As the preliminary treatment agent, for example, a water repellent agent is used. The water repellent agent has a function to repel water as primary component of the ink. For instance, paraffin-based water repellent agent, fluorine type compound, pyridinium salts, N-methylol alkylamide, alkyl ethylene urea, oxazaline derivative, silicone type compound, triazine type compound, zirconium type compound or mixture thereof may be used as water repellent agent. However, these water repellent agent are not exhaustive and thus are not taken as limitative. Amount of the water repellent agent to be applied to the cloth is in a range of 0.05 to 40 Wt %. If the amount of the water repellent agent is less than 0.05 Wt %, the water repellent agent may not penetrate into the cloth satisfactorily and thus satisfactory effect cannot be expected. On the other hand, when the amount exceeds 40 Wt %, no substantial gain of the performance can be attained in terms of performance.

In the cloth for textile printing, other compound may be constrained. For example, water soluble high-polymer, water soluble inorganic salt, surface active agent, urea, catalyst, alkali, acid, anti-reducing agent, anti-oxidizing agent, level dyeing agent, pachychromatic agent, carrier, reducing agent, oxydizing agent, metal ion and the like may be contained in the cloth. Particularly, as a material achieving bleeding prevention and/or improvement of color development ability, water soluble inorganic salt is effective. As water soluble inorganic salt, for example, alkali metal salt, such as NaCl, $Na_2SO_4$, KCl, $CH_3COONa$ and the like, alkali earth metal salt, such as $CaCl_2$, $MgCl_2$ and the like, and so on are preferred for use. Also, urea may achieve bleeding preventing effect and improvement of color development ability. It is preferred to use urea in combination with water soluble inorganic salt for attaining multiplier effect. A method for applying the foregoing material in the cloth may be any of pad method, spraying method, dipping method, printing method, ink-jet method and so on.

After the foregoing treatment, finally, drying and so on is performed. As required, cutting of the cloth into a size of the cloth which the printing apparatus can transport, is performed to prepare the cloth for ink-jet textile printing.

As the ink for textile printing to be used for cloth adapted for ink-jet textile printing, ink for ink-jet textile printing consisted of a reactive dye and an aqueous medium, is preferred in case where the cloth is cotton, silk, rayon and so on. On the other hand, the ink for ink-jet textile printing consisted of acid dye, direct dye and the like and aqueous medium, is preferred in the case where the cloth is nylon, wool, silk and the like. Also, the ink for water insoluble ink-jet textile printing consisted of a disperse dye and aqueous medium is preferred in the case where the cloth is polyester material.

As preferred particular examples of these dyes, C. I. reactive yellow 2, 15, 37, 42, 76, 95, 168, 175: C. I. reactive red 21, 22, 24, 33, 45, 111, 112, 114, 180, 218, 226, 228, 235: C. I. reactive blue 15, 19, 21, 38, 49, 72, 77, 176, 203, 220, 230, 235: C. I. reactive orange 5, 12, 13, 35, 95: C. I. reactive brown 7, 11, 33, 37, 46: C. I. reactive green 8, 19: C. I. reactive violet 2, 6, 22: C. I. reactive black 5, 8, 31, 39 and so on may be used.

As acid dye, direct dye, C. I. acid yellow 1, 7, 11, 17, 23, 25, 36, 38, 49, 72, 110, 127: C. I. acid red 1, 27, 35, 37, 57, 114, 138, 254, 257, 274: C. I. acid blue 7, 9, 62, 83, 90, 112, 185: C. I. acid black 26, 107, 109, 155: C. I. orange 56, 67, 149: C. I. direct yellow 12, 44, 50, 86, 106, 142: C. I. direct red 79, 80: C. I. direct blue 86, 106, 189, 199: C. I. direct black 17, 19, 22, 51, 154, 168, 173: C. I. direct orange 26, 39 and so on may be used.

As disperse dye, C. I. disperse yellow 3, 5, 7, 33, 42, 60, 64, 79, 104, 160, 163, 237: C. I. disperse red 1, 60, 135, 145, 146, 191: C. I. disperse blue 56, 60, 73, 143, 158, 198, 354, 365, 366: C. I. disperse black 1, 10: C. I. disperse orange 30, 73: tera print red 3GN liquid, tera print black 2R and so on may be used.

Use amount (solid component) of these dye is preferably in a range of 1 to 30 Wt % with respect to total amount of the ink.

On the other hand, as aqueous medium to be used together with the dye, typical one may be used. Preferably, lower alkylene glycols, such as ethylene glycol, diethylene glycol, triethylene glycol, propylene glycol or the like, lower alkyl ether of alkylene glycol, such as ethylene glycol methyl (or ethyl, propyl, buthyl) ether, diethylene glycol methyl (or ethyl, propyl, buthyl) ether, triethylene glycol methyl (or ethyl, propyl, buthyl) ether, propylene glycol methyl (or ethyl, propyl, buthyl) ether, dipropylene glycol methyl (or ethyl, propyl, buthyl) ether, tripropylene glycol methyl (or ethyl, propyl, buthyl) ether or the like, polyalkylene glycols, such as polyethylene glycol, polypropylene glycol and so on, hydroxyl protected substance containing one or two etheroxygen atoms thereof, typically represented by monoalkylether, dialkylether, glycerine, thiodiethylene glycol, sulfolane, N-methyl-2-pyrrolidine, 2-pyrrolidine, 1,3-dimethyl-2-imidazolidinone and so on may be used.

A content of these aqueous medium in the total amount of the ink is normally preferred in a range of 0 to 50 Wt %.

On the other hand, in case of a water-based ink, water as a primary component is preferably in a range of 30 to 95 Wt % with respect to the total weight of the ink.

Furthermore, as component of the ink, additives, such as urea and its derivatives as plugging preventing agent, disperse agent, surface-active agent, polyvinyl alcohol, cellulose type compound, sodium alginate and the like as viscosity modifier, pH modifier, fluorescent brightener, anti fungal agent and so on may be contained as required.

On the other hand, in addition to the dye ink, a pigment ink may also be used. In this case, the aqueous medium and component are similar to those of the dye ink.

As these inks, different kinds of inks may be used by exchanging the inks in the ink supply system path of the printing apparatus as set forth above, depending upon kind of the printing medium. For example, upon printing on cotton, a reactive dye ink is used. On the other hand, upon printing on polyester, disperse dye ink is used. It should be noted that when different kinds of inks are used, instead of exchanging the inks as set forth above, exchanging of the heads and the tanks may also be employed, for example.

Next, a general construction of the printing head 1100 to be employed in the shown embodiment of the textile printing apparatus will be explained with reference to FIG. 5.

Figure 5:
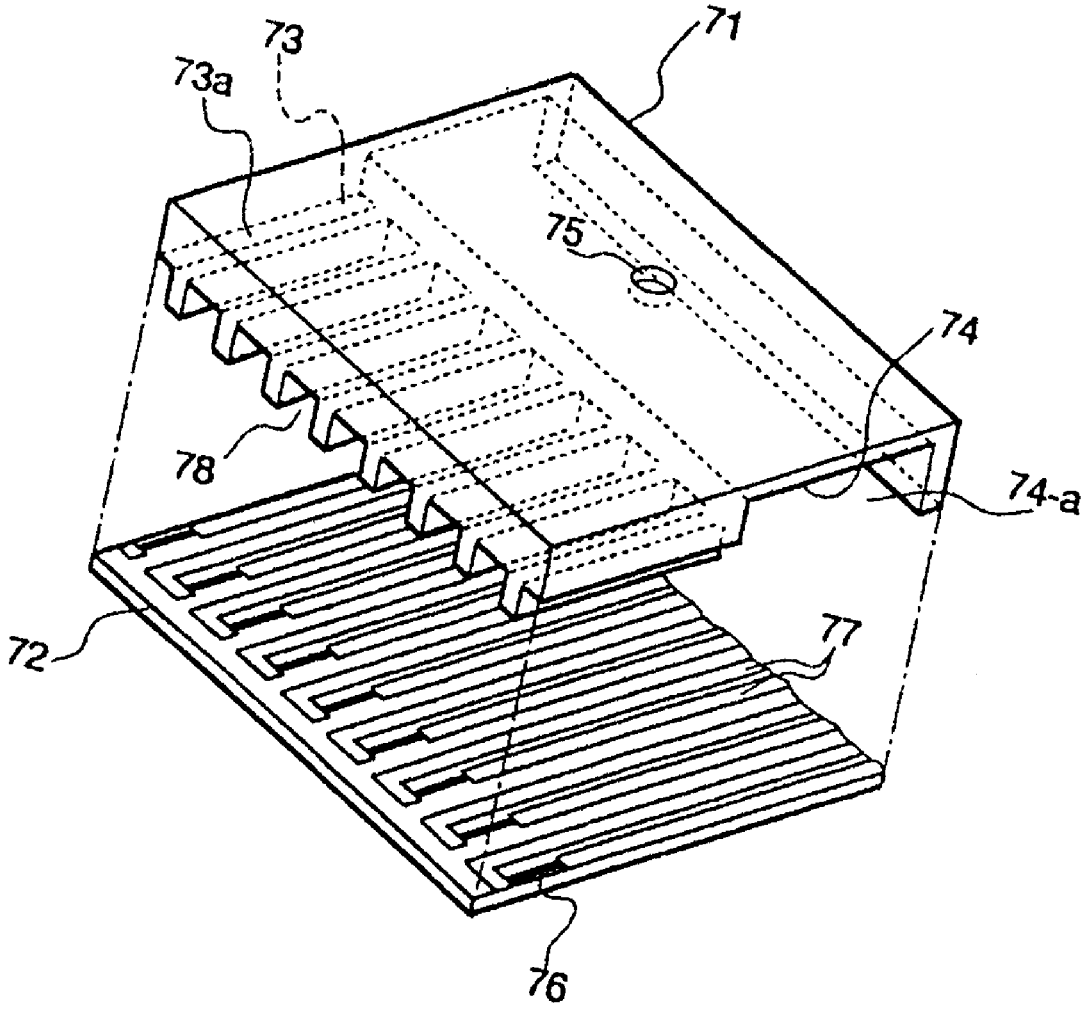
FIG. 5 is an exploded perspective view for explaining a general construction of a printing head mounted in the apparatus shown in FIG. 1.

FIG. 5 is an exploded perspective view showing a general construction of the printing head 1100 to be employed in the shown embodiment of the textile printing apparatus.

In FIG. 5, a primary structure of the printing head 1100 is formed by joining an upper plate 71 and a substrate 72. The upper plate 71 has grooves 73 for forming ink passages 73*a* communicated with the ink ejection openings 78, a groove 74 for forming a common liquid chamber 74*a* communicating with the ink passages 73*a*, and a supply opening 75 for supplying an ink from the ink supply tube and communicated with the common liquid chamber 74*a*. On the other hand, in the substrate 72, electrothermal transducers 76 corresponding to respective ink passages 73*a* and electrodes 77 supplying electric power to the electrothermal transducers 76 are formed integrally by a layer formation technology. By joining the upper plate 71 and the substrate 72 constructed each other as set forth above, a plurality of ink ejection openings (orifices) 78, the ink passages 73*a* and the common liquid chamber 74 are formed.

Also, in each printing head 1100, a sub-heater (not shown) and a temperature detecting sensor (not shown) are provided. A detection signal from the temperature detecting sensor is input to the control portion 260 (see FIG. 4). On the basis of this detection signal, the sub-heater is driven for performing heating for temperature adjustment when the printing head 1100 is in low temperature condition or other condition requiring driving of the sub-heater.

Here, an ink droplet formation process in the bubble-jet type performed by the printing head 1100 will be explained briefly.

At first, when a predetermined temperature is reached by applying a driving pulse to the heating resistor forming the electrothermal transducer 76, bubble film is generated covering the surface of the resistor. The internal pressure of the bubble is quite high to push out the ink in the ink passage 73*a*. The ink moves toward the ejection openings 78 and toward the common liquid chamber 74*a* in the opposite direction by an inertia force by pushing by the bubble. According to progress of movement of the ink, the internal pressure of the bubble becomes negative pressure, speed of the ink within the ink passage 73*a* is lowered due to flow path resistance. Since speed of the ink externally ejected from the ejection openings 78 is high in comparison with the speed of the ink within the ink passage 73*a* to form a neck to separate to form a liquid droplet due to balance of inertia force and flow path resistance, shrinking of the bubble and surface tension of the ink. On the other hand, within the ink passage 73*a*, at the same time of shrinking or extinction of the bubble, ink is supplied into the ink passage 73*a* from the common liquid chamber 74*a* by capillary force.

Thus, the printing head 1100 (hereinafter also referred to the ink-jet head) employing the electrothermal transducer 76 as energy generating means (hereinafter also referred to as energy generating element) can generate bubble in the ink within the ink passage 73*a* corresponding to the drive pulse in one-to-one relationship. On the other hand, since instant and proper growth and shrinking of the bubble can be effected, ink ejection particularly superior in response characteristics can be achieved. On the other hand, down-sizing of the printing head 1100 is easy. Furthermore, various advantages, such as sufficiently use and the merit of IC technology and macro processing technology according to progress of technology in the recent semiconductor field and significant improvement in reliability, high-density mounting can be facilitated, and production cost becomes low.

Next, the foregoing drive pulse will be explained with reference to FIG. 6.

Figure 6:
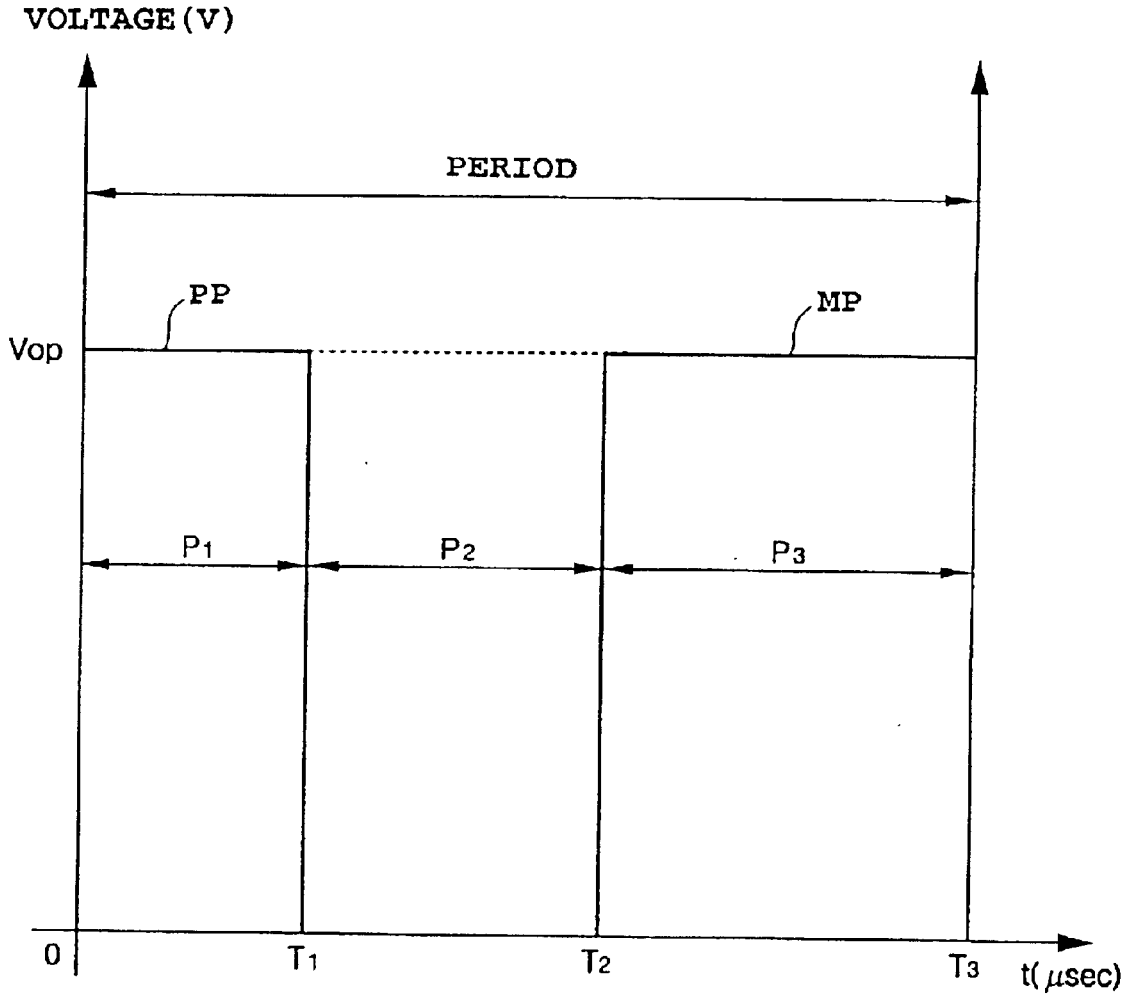
FIG. 6 is a diagrammatic illustration showing a pulse waveform of a drive pulse of the printing head to be employed in the shown embodiment of the present invention.

As shown in FIG. 6, the shown embodiment of the drive pulse is a divided pulse (double pulse) consisted of a pre-heat pulse PP and a main heat pulse MP. In FIG. 6, $V_{op}$ is a drive voltage, P1 is a pulse width of the pre-heat pulse PP, P2 is an interval time, P3 is a pulse width of the main heat pulse MP. T1, T2 and T3 represent time for determining P1, P2 and P3. The drive voltage $V_{op}$ provides an electrical energy necessary for generating the thermal energy in the ink within the ink passage 73*a*. The value of the drive voltage $V_{op}$ is determined depending upon an area, resistance value, film structure of the electrothermal transducer 76 and structure of the ink passage 73*a*, and so on. Divided pulse drive applies pulse having pulse widths of P1, P2 and P3 in sequential order. The pre-heat pulse PP is a pulse for controlling an ink temperature within the ink passage 73*a* to serve for controlling ejection amount. The pulse width P1 of the pre-heat pulse PP set at a value not causing bubbling phenomenon in the ink by the thermal energy generated by the electrothermal transducer 76.

The interval time P2 is provided for providing an interval of a given period so as to avoid interference between the pre-heat pulse PP and the main heat pulse MP and for making temperature distribution of the ink within the ink passage 73*a* uniform. The main pulse MP causes bubbling in the ink within the ink passage 73*a* or liquid passage for ejection of the ink from the ejection openings 78. The pulse width P3 is determined by area, resistance value and film structure of the electrothermal transducer 76 and the structure of the ink passage 73*a*.

A principle of ejection amount control by the double pulse is apply the energy for elevating the ink temperature by a variable pre-heat pulse PP. The energy is transmitted to up to a boundary region of bubble growth by the interval time P2 to form a desired ink temperature distribution. Thereafter, desired ink ejection amount can be obtained by the main heat pulse MP.

On the other hand, by applying the pre-heat pulse PP (see FIG. 7B) which is set so as not to generate the bubble, to the electrothermal transducer 76 of the ejection opening 78 not ejecting the ink, the temperature distribution in the head can be restricted to be relatively uniform. This can be achieved by applying only the pre-heat pulse PP as the drive pulse KP different from that upon ejection of the ink.

Figure 7A:
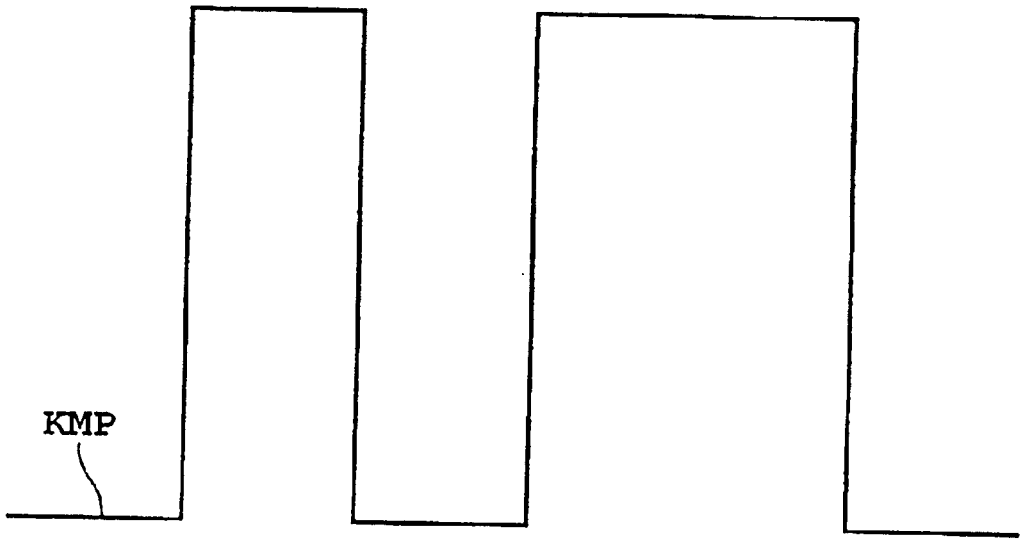
FIGS. 7A to 7B are diagrammatic illustration respectively showing a drive pulse upon performing ejection or a driven pulse while ejection is not performed, when a pulse shown in FIG. 6 is used.
Figure 7B:
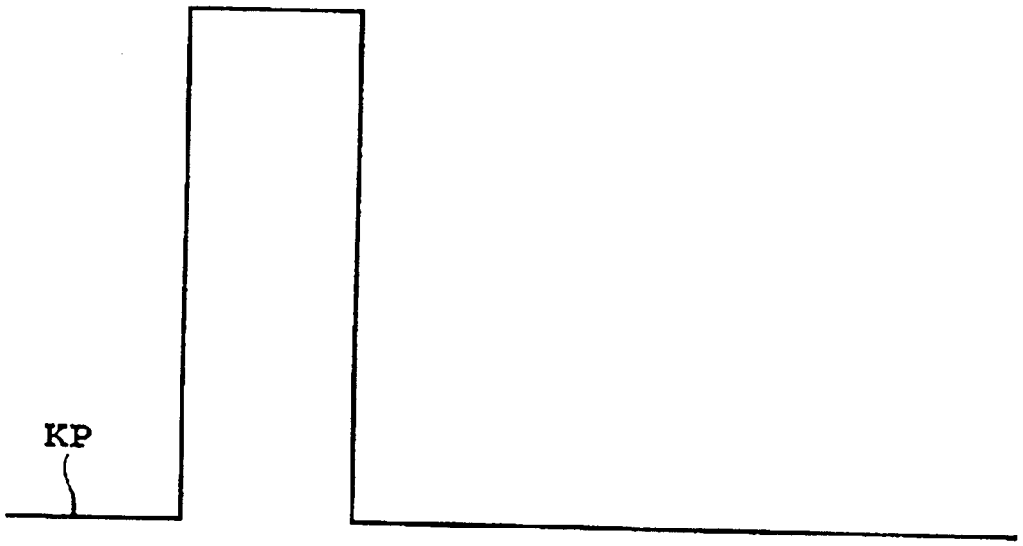

As shown in FIGS. 7A and 7B, the pulse width of the drive pulse KMP upon performing ejection is greater than the pulse width of the drive pulse corresponding to the ejection opening 78 not performing ejection in the extent of the pulse width of the main head pulse MP. However, in the ink passage 73*a* performing ejection, the thermal energy generating upon bubbling is spent by ejection of the ink droplet. Therefore, a heat accumulation amount becomes substantially equal in the ink passage 73*a* ejecting the ink and the ink passage 73*a* not ejecting the ink. With such method, even for the head having large number of the ejection opening 78, heat accumulating condition per respective ink passage of the head becomes substantially constant irrespective of the kind of the printing image (ratio of the ink passage 73*a* ejecting the ink and the ink passage 73*a* not ejecting the ink) to enable accurate control of the ejection amount.

In the shown embodiment, using the drive pulse KMP consisted of the pre-heat pulse PP and the main heat pulse MP, a process of the thermal energy generation amount control portion 260*b* (see FIG. 4) will be described hereinafter. The thermal energy generation amount control portion 260*b* transmits a control signal of the pulse width P1 of the pre-heat pulse PP and the pulse width P3 of the main heat pulse MP as shown in the following table 1 depending upon which of the ink A or the ink B is the discriminated ink.

TABLE 1

SET VALUE OF THE HEAD DRIVE PULSE

| | Ink A/(μsec) | Ink B/(μsec) |
|---|---|---|
| Pre-heat 1 | 0.9 | 0.6 |
| Pre-heat 2 | 1.0 | 0.7 |
| Pre-heat 3 | 1.1 | 0.8 |
| Pre-heat 4 | 1.3 | 1.0 |
| Main heat | 2.6 | 2.9 |

As shown in the table 1, by applying the pre-heat pulse PP having the pulse width P1 of four levels of pre-heat 1 to 4 for each ink, correction of variation of the ink ejection amount per the ejection opening 78 and temperature control can be performed. On the other hand, the pulse width P3 of the main heat pulse MP is constant for each of the ejection openings 78. On the other hand, the interval time P2 is 1.7 μs in either case of the ink A and ink B. The ink ejection amount in the shown embodiment by the foregoing drive pulse KMP becomes about 57 ng/ejection opening.

In such printing apparatus, the pulse width P1 of the pre-heat pulse PP is set within a range of 0.9 to 1.3 μsec in case of the ink A, and the pulse width P1 is set within a range of 0.6 to 1.0 μsec which is 0.3 μsec smaller in each level than that of the ink A, in case of the ink B.

On the other hand, the pulse width P3 of the main heat pulse MP is set at 2.6 μsec for the ink A and at 2.9 μsec which is 0.3 μsec greater than that in the ink A, for the ink B.

Accordingly, a total pulse width of the divided pulse to be applied to the electrothermal transducer 76 of each ink passage 73*a* becomes the same in a range of 3.5 to 3.9 μsec in both of the inks A and B.

As can be appreciated from the above, a generation amount of the thermal energy by the pre-heat pulse PP is greater in the ink A than that in the ink B. The reason is that damage of the printing head 1100 due to variation of property of the ink due to heat is greater in case of the ink B, and thus, when the ink B is used, the pulse width P1 of the pre-heat pulse PP applied even upon ink is not ejected, namely, thermal energy generation amount has to be set smaller than that in the ink A.

For example, when the disperse dye ink or the like explained later is used in the shown embodiment, as the ink B, a feature of the disperse dye ink looses dispersion ability by application of high heat to cause aggregation of dye to easily cause high viscosity. When such kind of ink is used, upon ink is ejected, the ink of the increased viscosity by heat is constantly discharged from the ink ejection opening 78 to reduce possibility of accumulation of the ink of the increased viscosity within the head. However, as set forth above, when the pre-heat pulse PP in the extent not causing bubble is applied to the electrothermal transducer 76 of the ejection opening 78 not performing ejection, the ink of the increased viscosity, loosing dispersion ability by the applied heat may reside in the vicinity of the ejection opening 78 of the printing head 1100 to be accumulated.

Accordingly, plugging of the ejection openings 78 of the printing head 1100 or deflection of the ejecting direction can be caused.

In order to avoid such problem, when the disperse dye ink is used as the ink B, the heat by pre-heating is restricted in the extent of the heating amount not loosing the dispersion ability of the disperse dye by making the pulse width of the pre-heat pulse PP small.

On the other hand, when the bubbling condition is different depending upon kind of the ink and the ink ejection amount is smaller in the case of the ink A than the case where the ink B is used, as means for making the ejection amount large to the extent of ejection amount-level of ink B, a method to increase the pulse width of the pre-heat pulse PP of the head ejecting the ink A is effective for elevating the ink temperature.

It should be noted that when the total pulse width of the divided pulse is excessively large in the case where both of the inks A and B are used, since life of the resistor of the electrothermal transducer 76 is shortened, the total pulse width cannot be made large in excess of certain extent. Therefore, in case of the ink for setting the pre-heat pulse PP greater, a setting in consideration of the life of the head, such as setting the pulse width of the main heat pulse MP smaller in the corresponding extent is preferred.

On the other hand, it is also possible to perform control to divide one to constantly apply the pre-heat pulse PP upon non-ejection or for the ejection opening 78 not ejecting the ink and one not to apply the pre-heat pulse PP upon non-ejection or for the ejection opening 78 not ejecting the ink depending upon the kinds of the inks.

For example, by performing control that when damage on the head 1100 by the heat is smaller in the case that the ink A is used, in comparison with the case that the ink B is used, the pre-heat pulse PP may be applied constantly even upon non-ejection, and when the ink B is used the pre-heat pulse PP is not applied up to immediately before entering into the printing region, heat generation amount by the pre-heat pulse PP can be reduced in total and whereby to reduce damage on the printing head 1100 by the heat.

And more specifically, the kinds of the inks set forth above are water soluble ink using reactive type, acid type, direct-type dye and so on as the ink A, and water insoluble ink using the disperse type dye or pigment ink and so on as the ink B, in practice.

Then, when kinds of the printing media to be used for printing is cotton, nylon, polyester, the ink to be used is reactive-type, acid-type and disperse type dye ink, and generation amount of the thermal energy is made smaller in case of the disperse dye ink than other kinds of inks.

One example of the ink composition to be used in the shown embodiment are as follows:

[Ink A]

1. (Reactive dye ink)

| | |
|---|---|
| reactive dye | 10 parts |
| thiodiglycol | 40 parts |
| water | 50 parts |

Used dyes are C. I. reactive yellow 95, C. I. reactive red 226, C. I. reactive blue 15 and C. I. reactive black 39.

2. (Acid dye ink)

| | |
|---|---|
| acid dye | 10 parts |
| diethylene glycol | 40 parts |
| water | 50 parts |

Used dyes are C. I. acid yellow 110, C. I. acid red 266, C. I. acid blue 90 and C. I. acid black 26.

[Ink B]

(Disperse dye ink)

| | |
|---|---|
| disperse dye | 10 parts |
| thiodiglycol | 40 parts |
| water | 50 parts |

Used dyes are C. I. disperse yellow 42, tera print red 3 GN liquid/disperse dye produced by Ciba-Geigy, tera print black 2R/disperse dye produced by Ciba-Geigy, and containing disperse agent.

Next, the printing operation of the shown embodiment will be explained with reference to FIG. 4, again.

During stand-by state of printing, the printing head 1100 is capped by the capping unit 200. On the other hand, before initiation of printing, by the ink/printing media discriminating portion 260*a*, the kind of the ink or the kind of the printing medium to be used for printing is discriminated. A discrimination signal corresponding to the kind of the ink on the basis of discrimination is fed to the thermal energy generation amount control portion 260*b*. In the control portion 260*b*, the head drive pulse condition, such as pulse widths of the pre-heat pulse PP and the main heat pulse MP, thermal energy generation amount of the drive pulse for the ejection opening 78 not performing ink ejection, is set.

When the print start signal is present, a motor (not shown) is driven to initiate movement of the carriage 1010. Associating with this movement, when each printing head 1100 is detected by the preliminary ejection position sensors (not shown), by the head driving control portion 250, the drive pulse is supplied to each printing head 1100 to perform preliminary ejection for a predetermined period to the plugging prevention unit 220. At this time, number of ink droplet to be ejected in the preliminary ejection is normally several to several hundreds. The preliminary ejection is performed for discharging the ink of the increased viscosity due to evaporation of the ink mainly from the ejection openings 78. Subsequently, the carriage 1010 is moved toward the printing medium. When the carriage 1010 is detected by the print start position sensor (not shown), each ejection opening 78 of the printing head 1100 is selectively driven depending upon the printing data. Accordingly, the ink droplet is ejected to print the image on the printing medium 1 in dot matrix pattern. Thus, printing for a predetermined width (arrangement width of the ejection openings 78 of the printing head 1100, for example).

Thereafter, the printing medium 1 is transported in a magnitude corresponding to the predetermined width by the transporting belt 130. Then, the motion direction of the carriage 1010 is reversed to perform printing in the reverse direction. By repeating the foregoing operation, the image is printed on the cloth 1.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high-density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670(1984) and 59-138461(1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for printing on a printing medium using a plurality of kinds of inks which produce impact of different levels on a printing head and using a plurality of thermal energy generating elements, the ink-jet printing apparatus comprising:

driving condition setting means for setting a driving condition of the thermal energy generating elements on the basis of the kind of ink; and head driving control means for controlling driving of the thermal energy generating elements for ejection on the basis of the driving condition set by said driving condition setting means, wherein said driving condition setting means sets a driving condition for a driving signal which is applied so as not to eject the ink, and the driving condition is set such that the driving signal is limited when using inks that have a larger impact on said printing head as compared with a case of using inks that have a smaller impact on said printing head.

2. An ink-jet printing apparatus as claimed in claim 1, wherein the driving condition of the thermal energy generating elements is a condition relating to a generation amount of thermal energy.

3. An ink-jet printing apparatus as claimed in claim 1 or 2, wherein at least one kind of the plurality of kinds of inks is a water insoluble ink or a pigment ink.

4. An ink-jet printing apparatus as claimed in claim 1 or 2, wherein the printing medium is a cloth.

5. An ink-jet printing apparatus as claimed in claim 1 or 2, wherein at least a combination of the printing medium being a polyester cloth and the ink being a disperse dye ink is included.

6. An ink-jet printing apparatus as claimed in claim 1 or 2, wherein the plurality of kinds of inks include a dye ink and a pigment ink.

7. An ink-jet printing apparatus as claimed in claim 1 or 2, wherein the plurality of kinds of inks include a reactive dye ink and a disperse dye ink.

8. An ink-jet printing apparatus as claimed in claim 1, wherein said inks that have a larger influence on said printing head are any one of a reactive type dye, and acid type dye, and a direct-type dye.

9. An ink-jet printing apparatus as claimed in claim 1, wherein said inks that have a smaller influence on said printing head are water insoluble ink using the disperse type dye or a pigment ink.

10. An ink-jet printing method of printing on a printing medium using a plurality of kinds of inks which produce impact of different levels on a printing head and using thermal energy generating elements, the ink-jet printing method comprising:

a step of setting a driving condition of the thermal energy generating elements on the basis of the kind of ink, wherein, said step of driving condition setting sets a driving condition for a driving signal which is applied so as not to eject the ink, and the driving condition is set such that the driving signal is limited when using inks that have a larger impact on said printing head as compared with a case of using inks that have a smaller impact on said printing head.

11. An ink-jet printing method as claimed in claim 10, wherein the driving condition is a condition relating to a generation amount of thermal energy.

12. An ink-jet printing method as claimed in claim 10 or 11, wherein at least one kind of the plurality of kinds of inks is a water insoluble ink or a pigment ink.

13. An ink-jet printing method as claimed in claim 10 or 11, wherein the printing medium is a cloth.

14. An ink-jet printing method as claimed in claim 10 or 11, wherein at least a combination of the printing medium being a polyester cloth and the ink being a disperse dye ink is included.

15. An ink-jet printing method as claimed in claim 10 or 11, wherein the plurality of kinds of inks include a dye ink and a pigment ink.

16. An ink-jet printing method as claimed in claim 10 or 11, wherein the plurality of kinds of inks include a reactive dye ink and a disperse dye ink.

* * * * *

UNITED STATES PATENT AND TRADEMARK OFFICE

CERTIFICATE OF CORRECTION

PATENT NO. : 6,863,359 B2
DATED : March 8, 2005
INVENTOR(S) : Takeshi Irizawa et al.

It is certified that error appears in the above-identified patent and that said Letters Patent is hereby corrected as shown below:

Title page,
Item [56], References Cited, FOREIGN PATENT DOCUMENTS,
"EP 646460 * 4/1995" and
"EP 736388 * 4/1996" should be deleted.
"05330122 A" should read -- 5-330122 A --.

Column 1,
Line 7, "9-349,701" should read -- 9349701 --.

Column 7,
Line 36, "metaacrylate," should read -- methacrylate, --.

Column 8,
Line 33, "in" (second occurrence) should read -- ink --.

Column 9,
Lines 66 and 67, "buthyl)" should read -- butyl) --.

Column 10,
Lines 1, 2, 3 and 4, "buthyl)" should read -- butyl) --.

Signed and Sealed this

Twenty-first Day of March, 2006

JON W. DUDAS
*Director of the United States Patent and Trademark Office*